US012044023B2

(12) United States Patent
Nguyen

(10) Patent No.: US 12,044,023 B2
(45) Date of Patent: Jul. 23, 2024

(54) UMBRELLA SUPPORT APPARATUS

(71) Applicant: Lock Nguyen, Morgan Hill, CA (US)

(72) Inventor: Lock Nguyen, Morgan Hill, CA (US)

( * ) Notice: Subject to any disclaimer, the term of this patent is extended or adjusted under 35 U.S.C. 154(b) by 375 days.

(21) Appl. No.: 17/412,190

(22) Filed: Aug. 25, 2021

(65) Prior Publication Data

US 2022/0061480 A1 Mar. 3, 2022

Related U.S. Application Data

(63) Continuation-in-part of application No. 29/751,631, filed on Sep. 22, 2020, now Pat. No. Des. 969,476.

(60) Provisional application No. 63/070,157, filed on Aug. 25, 2020.

(51) Int. Cl.

| | |
|---|---|
| ***E04H 12/22*** | (2006.01) |
| ***A45B 25/00*** | (2006.01) |
| *A45B 23/00* | (2006.01) |

(52) U.S. Cl.

CPC ..... *E04H 12/2246* (2013.01); *E04H 12/2269* (2013.01); *A45B 23/00* (2013.01); *A45B 2023/0012* (2013.01); *A45B 2025/003* (2013.01)

(58) Field of Classification Search

None

See application file for complete search history.

(56) References Cited

U.S. PATENT DOCUMENTS 3,784,136 A * 1/1974 Lopez ..... A47G 33/12 47/40.5
4,832,163 A * 5/1989 Levesque ..... A45B 3/00 108/14
6,895,982 B1 * 5/2005 Shaw ..... E04H 12/2246 135/16
7,980,185 B1 * 7/2011 Teague, Jr. ..... E05G 1/02 109/51
8,201,506 B1 * 6/2012 Parlapiano ..... E05G 1/005 70/201
8,720,349 B1 * 5/2014 David ..... A47B 37/04 211/133.4
9,463,850 B2 * 10/2016 Lovett ..... A45B 25/00
9,974,369 B1 5/2018 DePaolo
D969,476 S * 11/2022 Nguyen ..... D3/10
(Continued)

OTHER PUBLICATIONS

Cooletti, Cooletti New Bucket Accessory, Amazon.com, https://www.amazon.com/gp/product/B01I055H9U.

*Primary Examiner* — David R Dunn
*Assistant Examiner* — Danielle Jackson

(57) ABSTRACT

An umbrella support apparatus is an adapter device for supporting the shaft of an umbrella or parasol in an upright position. A first jaw panel and a second jaw panel as clamping members to support the shaft within a weighted base, with the first jaw panel and the second jaw panel releasably mounted to the weighted base. A shaft of the umbrella positioned through a shaft aperture in the first jaw panel and the second jaw panel, extending into the attached weighted base. A hinge assembly rotatably connects the first jaw panel to the second jaw panel to enable a user to attach the weighted base or adjust the shaft of the umbrella. Opposite the hinge assembly, a locking mechanism releasably fixes the first jaw panel and the second jaw panel together to prevent the shaft of the umbrella from deflecting within the shaft aperture.

19 Claims, 3 Drawing Sheets

(56) References Cited

U.S. PATENT DOCUMENTS

| | | | | |
|---|---|---|---|---|
| 2010/0107488 | A1* | 5/2010 | King | A01G 13/0212 47/20.1 |
| 2015/0083172 | A1 | 3/2015 | Boal | |
| 2015/0159394 | A1 | 6/2015 | Oliveira | |

* cited by examiner

UMBRELLA SUPPORT APPARATUS

The current application claims a priority to the U.S. Provisional Patent application Ser. No. 63/070,157 filed on Aug. 25, 2020.

FIELD OF THE INVENTION

The present invention generally relates to a support device configured to fix an umbrella in an upright position. More specifically, the present invention relates to a device designed to support and hold a rod or umbrella so that it can be securely attached to a generic bucket or other similar container.

BACKGROUND OF THE INVENTION

A device designed to provide a stable umbrella stand is in demand. Umbrellas or parasols can be used in many different outdoor settings, such as on an outdoor patio or balcony or in a garden, to provide shade.

At the beach or when otherwise spending time outside, it is often desirable to have an umbrella to provide protection from sunlight or weather. Beach umbrellas, which are usually larger than umbrellas intended for daily use, can be used when going to the beach or spending time outside. Some umbrellas are commonly used to protect people from rain or wind and are available in convenience stores and grocery stores or from hawkers. However, using an umbrella to ward off rain limits the operation of the hands. If a user needs to use both hands in the rain, such as if fishing or simply using a handheld device while carrying a bag, the user may need a way of holding an umbrella.

Beach umbrellas generally have a single central shaft, usually with a blunt or pointed end that users can insert into sand or ground to keep the umbrella upright. However, because of the loose nature of the ground or soil or amid windy conditions, the umbrella can move from its original position or fail to be secured even when the user has inserted the umbrella's end into the ground. Companies have introduced many different umbrella buckets and umbrella stands to solve these problems, but most are designed with unsecure and inconvenient mechanisms for holding the umbrella. Thus, there is a need to develop a device to solve these problems.

The present invention is intended to address problems associated with and/or otherwise improve on conventional devices through an innovative bucket stand device that is designed to provide a convenient means of supporting and securing an umbrella with a bucket while incorporating other problem-solving features. Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
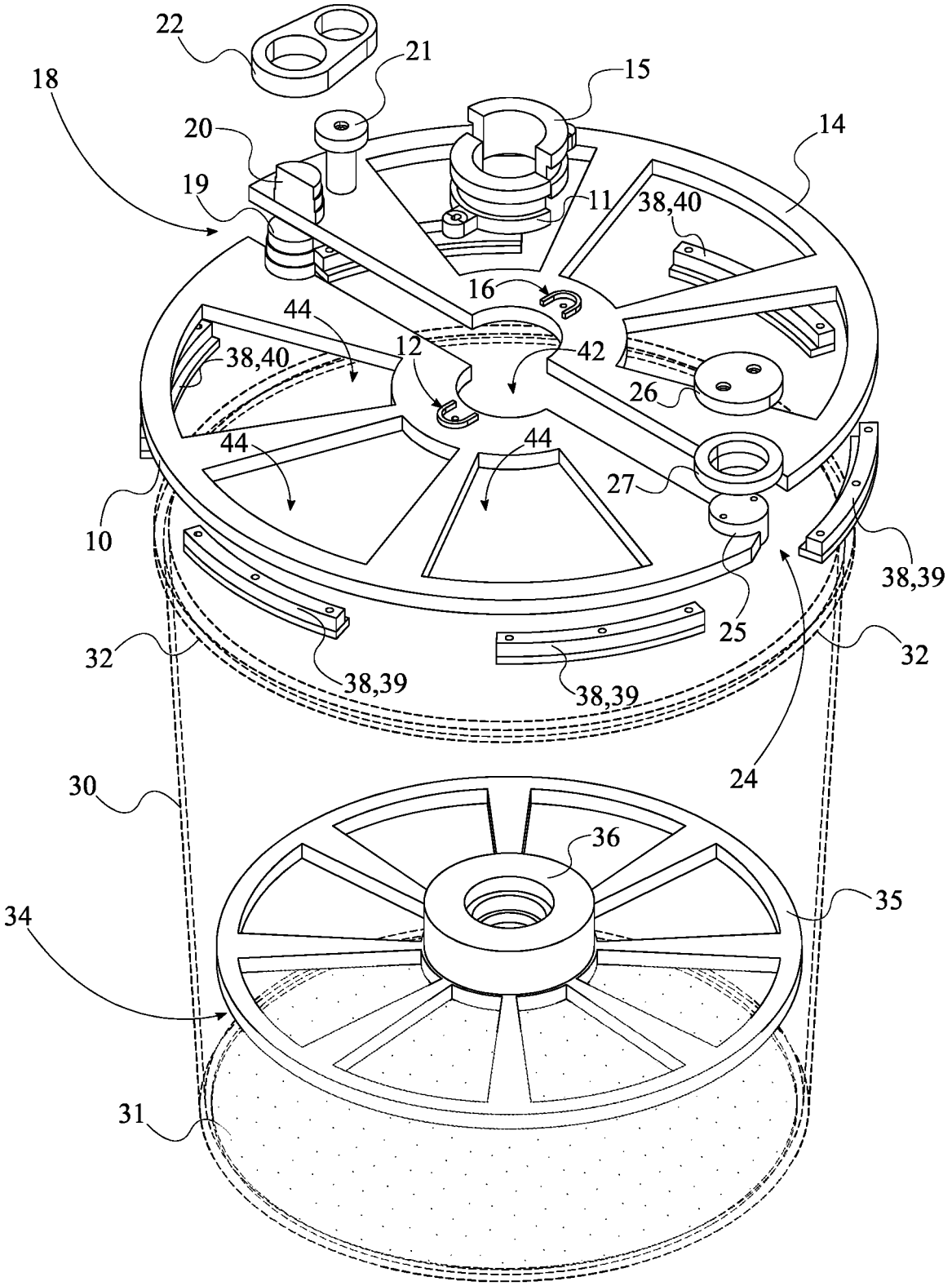
FIG. 1 is a top-front-left exploded view of one embodiment of the present invention, wherein portions of the present invention are rendered transparent to illustrate construction.
Figure 2:
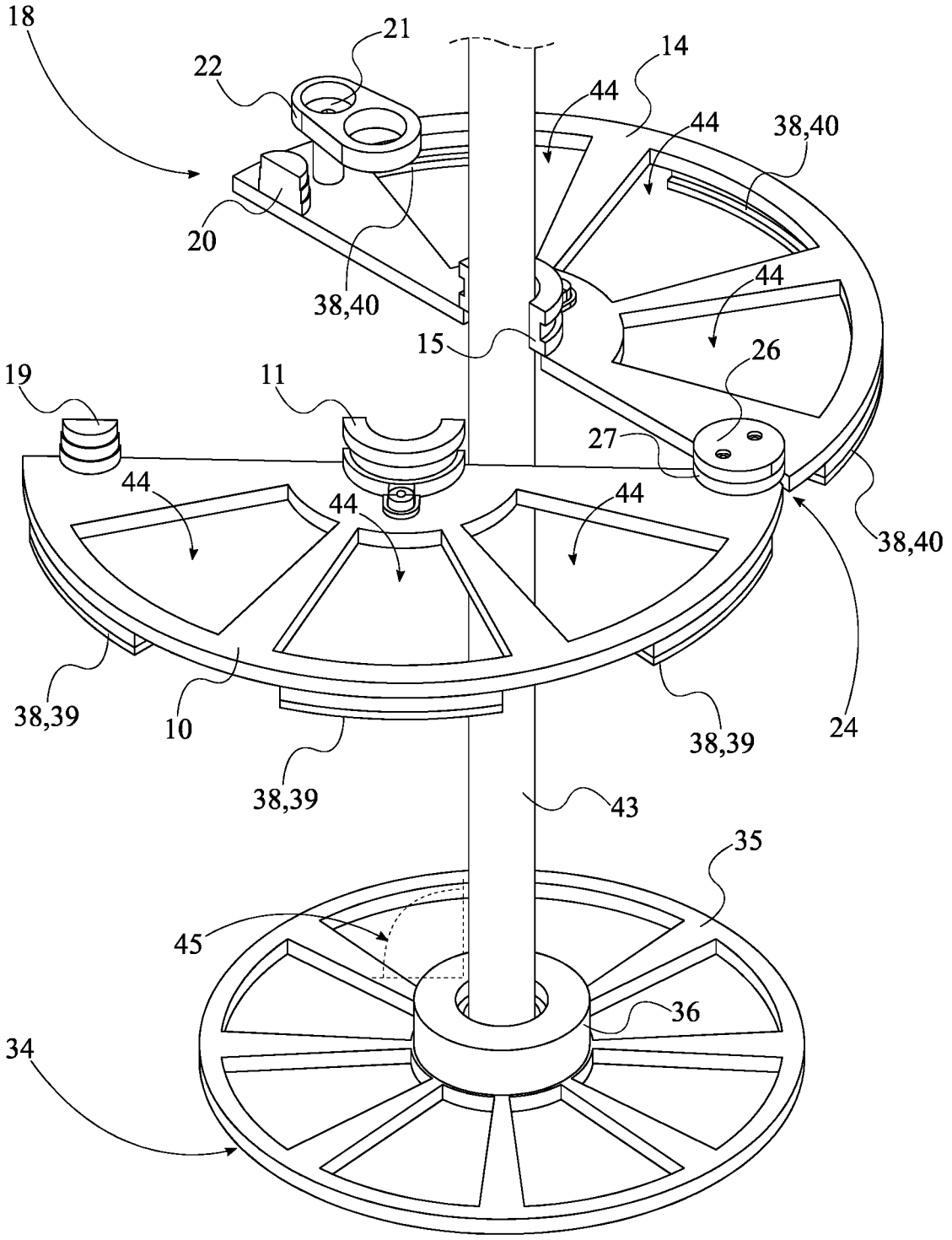
FIG. 2 is a top-front-left perspective view of one embodiment of the present invention, wherein the present invention is shown in an open configuration.
Figure 3:
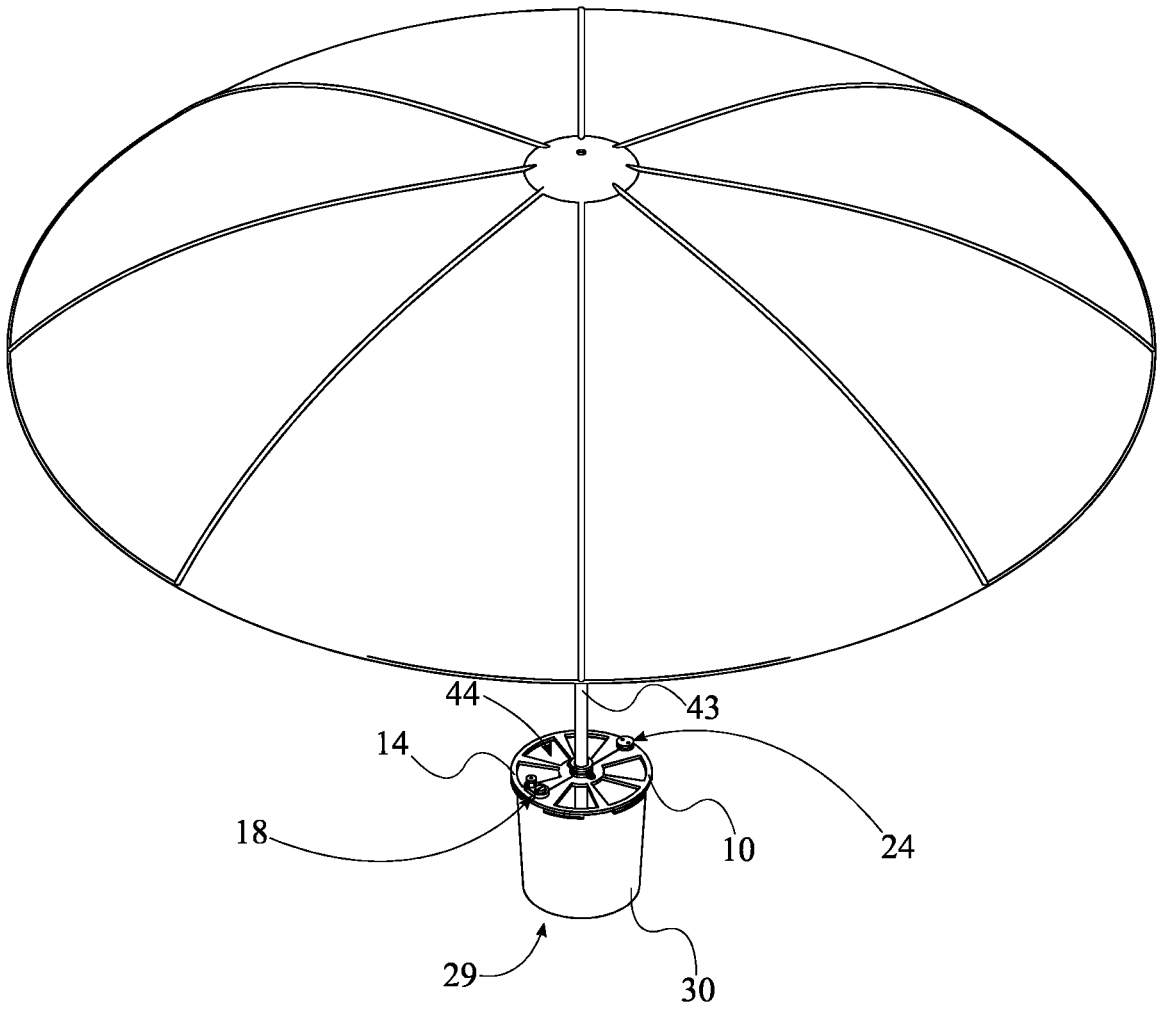
FIG. 3 top-front-right perspective view of the present invention, wherein the present invention is illustrated supporting an exemplary umbrella.

In reference to FIG. 1 through 3, the present invention is an umbrella support apparatus comprising an umbrella support apparatus comprising a first jaw panel 10, a second jaw panel 14, a shaft aperture 42, a hinge assembly 24, a locking mechanism 18, and a weighted base 29.

The first jaw panel 10 and the second jaw panel 14 define approximately equal halves of a clamping structure configured to capture and support an umbrella or parasol in an upright position. The shaft aperture 42 traverses the first jaw panel 10 and the second jaw panel 14 perpendicular to the first jaw panel 10 and the second jaw panel 14, providing an unobstructed path between both the first jaw panel 10 and the second jaw panel 14 into which an umbrella shaft 43 of an umbrella may be mounted. In this position, the umbrella shaft 43 is supported by both the first jaw panel 10 and the second jaw panel 14 as shown in FIG. 3.

The locking mechanism 18 is releasably mounted between the first jaw panel 10 and the second jaw panel 14, opposite the hinge assembly 24 across the shaft aperture 42. The locking mechanism 18 constitutes any releasable mechanical engagement between the first jaw panel 10 and the second jaw panel 14, enabling the release of the supported umbrella and the removal of the weighted base 29 in various modes of use. Further, the first jaw panel 10 and the second jaw panel 14 are mounted to the weighted base 29, wherein the locking mechanism 18 operably engages the first jaw panel 10, the second jaw panel 14, and the weighted base 29. In a preferred embodiment of the present invention, the weighted base 29 defines a conventional bucket configured for use with the present invention. However, it is broadly contemplated that the weighted base 29 might encompass any type of mountable substructure suitable for supporting the umbrella shaft 43. Accordingly, the shaft aperture 42 and the weighted base 29 are configured to receive the umbrella shaft 43 of an umbrella in an installed configuration, wherein the umbrella shaft 43 traverses through the shaft aperture 42 into the weighted base 29 in the installed configuration.

As shown in FIGS. 1 and 2, the locking mechanism 18 comprises a first tapered peg 19, a second tapered peg 20, a pivot post 21, and a locking ring 22. The first tapered peg 19 is mounted to the first jaw panel 10 and the second tapered peg 20 is mounted to the second jaw panel 14, adjacent to the first tapered peg 19. The first tapered peg 19 and the second tapered peg 20 ideally constitute bilaterally divided conical structures, whereby the closure of the first jaw and the second jaw combines the first tapered peg 19 and the second tapered peg 20 into a single tapered structure to be engaged by the locking ring 22 as shown in FIG. 3. Accordingly, the pivot post 21 is mounted to the second jaw panel 14, opposite the first tapered peg 19 across the second tapered peg 20. The locking ring 22 is rotatably mounted to the pivot post 21 to enable the user to engage and disengage the locking mechanism 18 without removing the locking ring 22 from the pivot post 21. The locking ring 22 is removably positioned around the first tapered peg 19 and the second tapered peg 20 as shown in FIG. 2, enabling the first jaw panel 10 and the second jaw panel 14 to actuate between a locked and unlocked position when the locking ring 22 is removed from the first tapered peg 19 and the second tapered peg 20.

In at least one embodiment, the hinge assembly 24 further comprises an axle 25, a knuckle bearing 27, and a hinge cap 26 as illustrated in FIG. 1. The axle 25 is mounted to the first jaw panel 10 and the knuckle bearing 27 is mounted to the second jaw panel 14, wherein the axle 25 and the knuckle bearing 27 ideally constitute molded-in portions of each respective component. The knuckle bearing 27 is further mounted about the axle 25, with the hinge cap 26 mounted to the axle 25 to prevent the knuckle bearing 27 from slipping off the axle 25. More specifically, the knuckle bearing 27 is positioned between the hinge cap 26 and the first jaw panel 10. This arrangement creates a rotational relationship between the second jaw panel 14 and the first jaw panel 10 about the axle 25, wherein the angular offset between the first jaw panel 10 and the second jaw panel 14 is limited by the dimensions of the knuckle bearing 27 as shown in FIG. 2.

In the preferred embodiment of the present invention, the weighted base 29 is defined by a conventional bucket filled with sand, soil, rocks, or other loose materiel to provide adequate support to an umbrella or parasol as shown in FIG. 3. In this embodiment the weighted base 29 further comprises a container 30 and a volume of countermass 31, wherein the container 30 is analogous to a common bucket and the volume of countermass 31 is analogous to sand within said bucket. The first jaw panel 10 and the second jaw panel 14 also further comprise a plurality of filling apertures 44 traversing the first jaw panel 10 and the second jaw panel 14 with the first jaw panel 10 and the second jaw panel 14 being configured to releasably attach to the container 30. With the first jaw panel 10 and the second jaw panel 14 mounted to the container 30, the volume of countermass 31 is positioned into the container 30. In a common mode of use, a user will fill the container 30 with the volume of countermass 31 through the plurality of filling apertures 44 with the umbrella shaft 43 positioned through the shaft aperture 42, thereby ensuring that the umbrella shaft 43 is fully engaged into the volume of countermass 31 within the container 30.

It is further considered that the weighted base 29 may provide angular support to the umbrella shaft 43 in addition to providing a solid base to maintain an upright position. More specifically, the weighted base 29 may provide means for a user to fix and adjust the angular projection of the shaft of the umbrella from the weighted base 29 to maintain perfect vertical orientation or to enable an offset tilt. Accordingly, the weighted base 29 further comprises a support plate 34 to both provide additional mass to the weighted base 29 and to provide a dedicated support for the shaft of the umbrella within the weighted base 29. The support plate 34 is positioned into the container 30, wherein the support plate 34 is configured to receive the umbrella shaft 43 as shown in FIG. 2.

In at least one additional embodiment, the support plate 34 further comprises a perforated panel 35 and a receiver cup 36. The receiver cup 36 is configured to receive the umbrella shaft 43, wherein a shaft angle 45 is defined between the umbrella shaft 43 and the receiver cup 36. The perforated panel 35 is mounted to the receiver cup 36, wherein the perforated panel 35 extends to the internal dimensions of the container 30 as shown in FIG. 1. Though the illustrated embodiment indicates a perfectly vertical arrangement, various alternate embodiments of the support plate 34 may position the receiver cup 36 in a non-concentric position relative to the perforated panel 35. This arrangement enables a user to 'clock' the umbrella shaft 43 by rotating the perforated panel 35 within the container 30, thereby adjusting the angular offset of the receiver cup 36 to the shaft aperture 42.

The present invention is ideally compatible with any type or variety of parasol, umbrella, flagpole, or any other comparable structure. Accordingly, the shaft aperture 42 ideally conforms to the dimensions of any object positioned therethrough. To enable this functionality, the first jaw panel 10 further comprises a first collar 11 and a first channel 12. Additionally, the second jaw panel 14 further comprises a second collar 15 and a second channel 16, positionally and functionally mirroring the arrangement of the first jaw panel 10 as shown in FIGS. 1 and 2. The first channel 12 is formed into the first jaw panel 10 adjacent to the shaft aperture 42, wherein the first collar 11 releasably mounts into the first channel 12. Accordingly, the second channel 16 is formed into the second jaw panel 14 adjacent to the shaft aperture 42, wherein the second collar 15 is releasably mounted into the second channel 16. The first collar 11 and the second collar 15 are configured to constrict the shaft aperture 42 around the umbrella shaft 43 in the exemplary embodiment. It is broadly considered that the first collar 11 and the second collar 15 may be exchanged for equivalent versions of similar components to accommodate various items within the shaft aperture 42 without departing from the original spirit and scope of the present invention. Further, the application of the first collar 11 and the second collar 15 should extend to any structure similar to the umbrella shaft 43 as may be realized by a reasonably skilled individual.

In the broadest conception of the present invention, any suitably dense item or object may be employed as the weighted base 29, given an appropriate means to engage the first jaw panel 10 and the second jaw panel 14 to said item. In reference to FIGS. 1 and 2, a plurality of retainer clamps 38 is radially distributed across the first jaw panel 10 and the second jaw panel 14. The plurality of retainer clamps 38 is removably mounted between the weighted base 29, the first jaw panel 10, and the second jaw panel 14. Further, the plurality of retainer clamps 38 encompasses any type, variety, or combination of fasteners that may be employed by a reasonably skilled individual to mount the weighted base 29 to the first jaw panel 10, the second jaw panel 14, or both the first jaw panel 10 and second jaw panel 14 in combination.

As outlined above, the present invention preferably makes use of a conventional bucket in at least one embodiment of the weighted base 29. This embodiment is generally preferred for the ubiquity of durable contractor buckets, and the suitable mounting structures thereon. In reference to FIG. 1, the plurality of retainer clamps 38 further comprises a first plurality of clamps 39 and a second plurality of clamps 40. The weighted base 29 further comprising at least one mounting shelf 32, wherein the mounting shelf is generally analogous to the lip or rim of a contractor bucket conventionally used to accept a removeable lid. The first plurality of clamps 39 is mounted to the first jaw panel 10 and the second plurality of clamps 40 is mounted to the second jaw panel 14. This arrangement enables the first plurality of clamps 39 and the second plurality of clamps 40 to operate independently, whereby one side may be affixed to the at least one mounting shelf 32 before the other side is rotated to a closed position on the weighted base 29. More specifically, the at least one mounting shelf 32 is configured to receive the first plurality of clamps 39 and the second plurality of clamps 40, wherein the rotation of the first jaw panel 10 relative to the second jaw panel 14 about the hinge mechanism engages the plurality of retainer clamps 38 to the at least one mounting shelf 32.

Although the invention has been explained in relation to its preferred embodiment, it is to be understood that many other possible modifications and variations can be made without departing from the spirit and scope of the invention as hereinafter claimed.

What is claimed is:

1. An umbrella support apparatus comprising:

a first jaw panel;

a second jaw panel;

a shaft aperture;

a hinge assembly;

a locking mechanism;

a weighted base;

the shaft aperture traversing through the first jaw panel and the second jaw panel perpendicular to the first jaw panel and the second jaw panel;

the locking mechanism being releasably mounted between the first jaw panel and the second jaw panel, opposite the hinge assembly across the shaft aperture;

the first jaw panel and the second jaw panel being mounted to the weighted base, wherein the locking mechanism operably engages the first jaw panel and the second jaw panel;

a shaft of an umbrella being positioned through the shaft aperture into the weighted base;

the locking mechanism comprising a first tapered peg, a second tapered peg, a pivot post, and a locking ring;

the first tapered peg being mounted to the first jaw panel;

the second tapered peg being mounted to the second jaw panel, adjacent to the first tapered peg;

the pivot post being mounted to the second jaw panel, opposite the first tapered peg across the second tapered peg;

the locking ring being rotatably mounted to the pivot post; and the locking ring being removably positioned around the first tapered peg and the second tapered peg.

2. The umbrella support apparatus as claimed in claim 1 comprising:

the hinge assembly further comprising an axle, a knuckle bearing, and a hinge cap;

the axle being mounted to the first jaw panel;

the knuckle bearing being mounted to the second jaw panel;

the knuckle bearing being mounted about the axle; and the hinge cap being mounted to the axle, wherein the knuckle bearing is positioned between the hinge cap and the first jaw panel.

3. The umbrella support apparatus as claimed in claim 1 comprising:

the weighted base further comprising a container and a volume of countermass;

the first jaw panel and the second jaw panel further comprising a plurality of filling apertures traversing through the first jaw panel and the second jaw panel;

the first jaw panel and the second jaw panel each being releasably attached to the container;

the volume of countermass being positioned into the container through the plurality of filling apertures; and the container being configured to retain the volume of countermass.

4. The umbrella support apparatus as claimed in claim 1 comprising:

the weighted base further comprising a support plate; and the support plate being positioned into the container, wherein the support plate is configured to receive the umbrella shaft.

5. The umbrella support apparatus as claimed in claim 4 comprising:

the support plate further comprising a perforated panel and a receiver cup;

the receiver cup being configured to receive the umbrella shaft, wherein a shaft angle is defined between the umbrella shaft and the receiver cup; and the perforated panel being mounted to the receiver cup;

the perforated panel extending between the receiver cup and an interior lateral wall of the container.

6. The umbrella support apparatus as claimed in claim 1 comprising:

the first jaw panel further comprising a first collar and a first channel;

the second jaw panel further comprising a second collar and a second channel;

the first channel being formed into the first jaw panel adjacent to the shaft aperture, wherein the first collar releasably mounts into the first channel;

the second channel being formed into the second jaw panel adjacent to the shaft aperture, wherein the second collar is releasably mounted into the second channel; and the first collar and the second collar being configured to constrict the shaft aperture around the umbrella shaft.

7. The umbrella support apparatus as claimed in claim 1 comprising:

a plurality of retainer clamps being radially distributed about the first jaw panel and the second jaw panel; and the plurality of retainer clamps being removably mounted between the weighted base, the first jaw panel, and the second jaw panel.

8. The umbrella support apparatus as claimed in claim 7 comprising:

the plurality of retainer clamps further comprising a first plurality of clamps and a second plurality of clamps;

the weighted base further comprising at least one mounting shelf;

the first plurality of clamps being mounted to the first jaw panel and the second plurality of clamps being mounted to the second jaw panel; and the at least one mounting shelf being configured to receive the first plurality of clamps and the second plurality of clamps, wherein the rotation of the first jaw panel relative to the second jaw panel about the hinge mechanism engages the plurality of retainer clamps to the at least one mounting shelf.

9. An umbrella support apparatus comprising:
a first jaw panel;
a second jaw panel;
a shaft aperture;
a hinge assembly;
a locking mechanism;
a weighted base;
the shaft aperture traversing through the first jaw panel and the second jaw panel perpendicular to the first jaw panel and the second jaw panel;
the locking mechanism being releasably mounted between the first jaw panel and the second jaw panel, opposite the hinge assembly across the shaft aperture;
the first jaw panel and the second jaw panel being mounted to the weighted base, wherein the locking mechanism operably engages the first jaw panel and the second jaw panel;
a shaft of an umbrella being positioned through the shaft aperture into the weighted base;
the weighted base further comprising a support plate;
the support plate being positioned into the container, wherein the support plate is configured to receive the umbrella shaft;
a plurality of retainer clamps being radially distributed about the first jaw panel and the second jaw panel; and
the plurality of retainer clamps being removably mounted between the weighted base, the first jaw panel, and the second jaw panel.

10. The umbrella support apparatus as claimed in claim 9 comprising:
the locking mechanism comprising a first tapered peg, a second tapered peg, a pivot post, and a locking ring;
the first tapered peg being mounted to the first jaw panel;
the second tapered peg being mounted to the second jaw panel, adjacent to the first tapered peg;
the pivot post being mounted to the second jaw panel, opposite the first tapered peg across the second tapered peg;
the locking ring being rotatably mounted to the pivot post; and
the locking ring being removably positioned around the first tapered peg and the second tapered peg.

11. The umbrella support apparatus as claimed in claim 9 comprising:
the hinge assembly further comprising an axle, a knuckle bearing, and a hinge cap;
the axle being mounted to the first jaw panel;
the knuckle bearing being mounted to the second jaw panel;
the knuckle bearing being mounted about the axle; and
the hinge cap being mounted to the axle, wherein the knuckle bearing is positioned between the hinge cap and the first jaw panel.

12. The umbrella support apparatus as claimed in claim 9 comprising:
the weighted base further comprising a container and a volume of countermass;
the first jaw panel and the second jaw panel further comprising a plurality of filling apertures traversing through the first jaw panel and the second jaw panel;
the first jaw panel and the second jaw panel each being releasably attached to the container;
the volume of countermass being positioned into the container through the plurality of filling apertures; and
the container being configured to retain the volume of countermass.

13. The umbrella support apparatus as claimed in claim 9 comprising:
the support plate further comprising a perforated panel and a receiver cup;
the receiver cup being configured to receive the umbrella shaft, wherein a shaft angle is defined between the umbrella shaft and the receiver cup; and
the perforated panel being mounted to the receiver cup;
the perforated panel extending between the receiver cup and an interior lateral wall of the container.

14. The umbrella support apparatus as claimed in claim 9 comprising:
the first jaw panel further comprising a first collar and a first channel;
the second jaw panel further comprising a second collar and a second channel;
the first channel being formed into the first jaw panel adjacent to the shaft aperture, wherein the first collar releasably mounts into the first channel;
the second channel being formed into the second jaw panel adjacent to the shaft aperture, wherein the second collar is releasably mounted into the second channel; and
the first collar and the second collar being configured to constrict the shaft aperture around the umbrella shaft.

15. The umbrella support apparatus as claimed in claim 9 comprising:
the plurality of retainer clamps further comprising a first plurality of clamps and a second plurality of clamps;
the weighted base further comprising at least one mounting shelf;
the first plurality of clamps being mounted to the first jaw panel and the second plurality of clamps being mounted to the second jaw panel; and
the at least one mounting shelf being configured to receive the first plurality of clamps and the second plurality of clamps, wherein the rotation of the first jaw panel relative to the second jaw panel about the hinge mechanism engages the plurality of retainer clamps to the at least one mounting shelf.

16. An umbrella support apparatus comprising:
a first jaw panel;
a second jaw panel;
a shaft aperture;
a hinge assembly;
a locking mechanism;
a weighted base;
the shaft aperture traversing through the first jaw panel and the second jaw panel perpendicular to the first jaw panel and the second jaw panel;
the locking mechanism being releasably mounted between the first jaw panel and the second jaw panel, opposite the hinge assembly across the shaft aperture;
the first jaw panel and the second jaw panel being mounted to the weighted base, wherein the locking mechanism operably engages the first jaw panel and the second jaw panel;
a shaft of an umbrella being positioned through the shaft aperture into the weighted base;
the weighted base further comprising a support plate;
the support plate being positioned into the container, wherein the support plate is configured to receive the umbrella shaft;
a plurality of retainer clamps being radially distributed about the first jaw panel and the second jaw panel;

the plurality of retainer clamps being removably mounted between the weighted base, the first jaw panel, and the second jaw panel;

the locking mechanism comprising a first tapered peg, a second tapered peg, a pivot post, and a locking ring;

the first tapered peg being mounted to the first jaw panel;

the second tapered peg being mounted to the second jaw panel, adjacent to the first tapered peg;

the pivot post being mounted to the second jaw panel, opposite the first tapered peg across the second tapered peg;

the locking ring being rotatably mounted to the pivot post;

the locking ring being removably positioned around the first tapered peg and the second tapered peg;

the hinge assembly further comprising an axle, a knuckle bearing, and a hinge cap;

the axle being mounted to the first jaw panel;

the knuckle bearing being mounted to the second jaw panel;

the knuckle bearing being mounted about the axle;

the hinge cap being mounted to the axle, wherein the knuckle bearing is positioned between the hinge cap and the first jaw panel;

the first jaw panel further comprising a first collar and a first channel;

the second jaw panel further comprising a second collar and a second channel;

the first channel being formed into the first jaw panel adjacent to the shaft aperture, wherein the first collar releasably mounts into the first channel;

the second channel being formed into the second jaw panel adjacent to the shaft aperture, wherein the second collar is releasably mounted into the second channel; and the first collar and the second collar being configured to constrict the shaft aperture around the umbrella shaft.

17. The umbrella support apparatus as claimed in claim 16 comprising:

the weighted base further comprising a container and a volume of countermass;

the first jaw panel and the second jaw panel further comprising a plurality of filling apertures traversing through the first jaw panel and the second jaw panel;

the first jaw panel and the second jaw panel each being releasably attached to the container;

the volume of countermass being positioned into the container through the plurality of filling apertures; and the container being configured to retain the volume of countermass.

18. The umbrella support apparatus as claimed in claim 16 comprising:

the support plate further comprising a perforated panel and a receiver cup;

the receiver cup being configured to receive the umbrella shaft, wherein a shaft angle is defined between the umbrella shaft and the receiver cup; and the perforated panel being mounted to the receiver cup;

the perforated panel extending between the receiver cup and an interior lateral wall of the container.

19. The umbrella support apparatus as claimed in claim 16 comprising:

the plurality of retainer clamps further comprising a first plurality of clamps and a second plurality of clamps;

the weighted base further comprising at least one mounting shelf;

the first plurality of clamps being mounted to the first jaw panel and the second plurality of clamps being mounted to the second jaw panel; and the at least one mounting shelf being configured to receive the first plurality of clamps and the second plurality of clamps, wherein the rotation of the first jaw panel relative to the second jaw panel about the hinge mechanism engages the plurality of retainer clamps to the at least one mounting shelf.

* * * * *